US007144312B2

(12) United States Patent
Boyle

(10) Patent No.: US 7,144,312 B2
(45) Date of Patent: Dec. 5, 2006

(54) SCRATCH REMOVAL TOOL AND SYSTEM

(75) Inventor: Michael P. Boyle, Sisters, OR (US)

(73) Assignee: Glas-Weld Systems, Inc., Bend, OR (US)

( * ) Notice: Subject to any disclaimer, the term of this patent is extended or adjusted under 35 U.S.C. 154(b) by 53 days.

(21) Appl. No.: 10/992,869

(22) Filed: Nov. 18, 2004

(65) Prior Publication Data

US 2005/0170758 A1 Aug. 4, 2005

Related U.S. Application Data

(60) Provisional application No. 60/536,779, filed on Jan. 16, 2004.

(51) Int. Cl.
*B24B 55/02* (2006.01)

(52) U.S. Cl. ..... 451/449; 451/446; 451/359

(58) Field of Classification Search ..... 451/449, 451/450, 446, 359

See application file for complete search history.

(56) References Cited

U.S. PATENT DOCUMENTS 1,679,323 A * 7/1928 Mortlock ..... 15/29
3,104,783 A * 9/1963 Hall ..... 222/191
3,110,993 A * 11/1963 Grace ..... 451/450
5,649,508 A * 7/1997 Rost et al. ..... 222/191
5,651,727 A * 7/1997 Weinstein et al. ..... 451/344

* cited by examiner

*Primary Examiner*—Dung Van Nguyen
(74) *Attorney, Agent, or Firm*—Schwabe, Williamson & Wyatt, P.C.

(57) ABSTRACT

A system for removing scratches from glass windows, windshields and the like utilizing a compound applied to a powered polishing disk/pad which effectively "scrubs" away the scratches. Liquid needs to be applied during the process. To enable the operator to use both hands to maneuver the tool while also controlling the liquid application procedure, a hand piece is mounted to the tool which functions both as a second handle for the operator and also places a finger/thumb actuated liquid spray control accessible to the operator. A nozzle connected to the control and receiving liquid from the control is mounted for directing spray onto the glass surface outboard of the periphery of the pad.

8 Claims, 3 Drawing Sheets

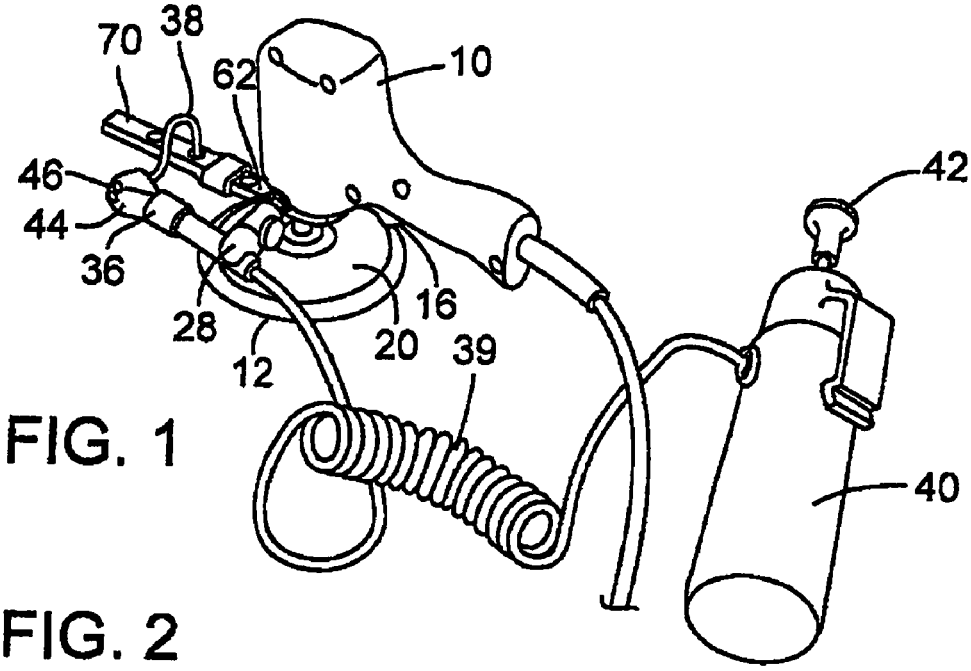
FIG. 1
FIG. 2
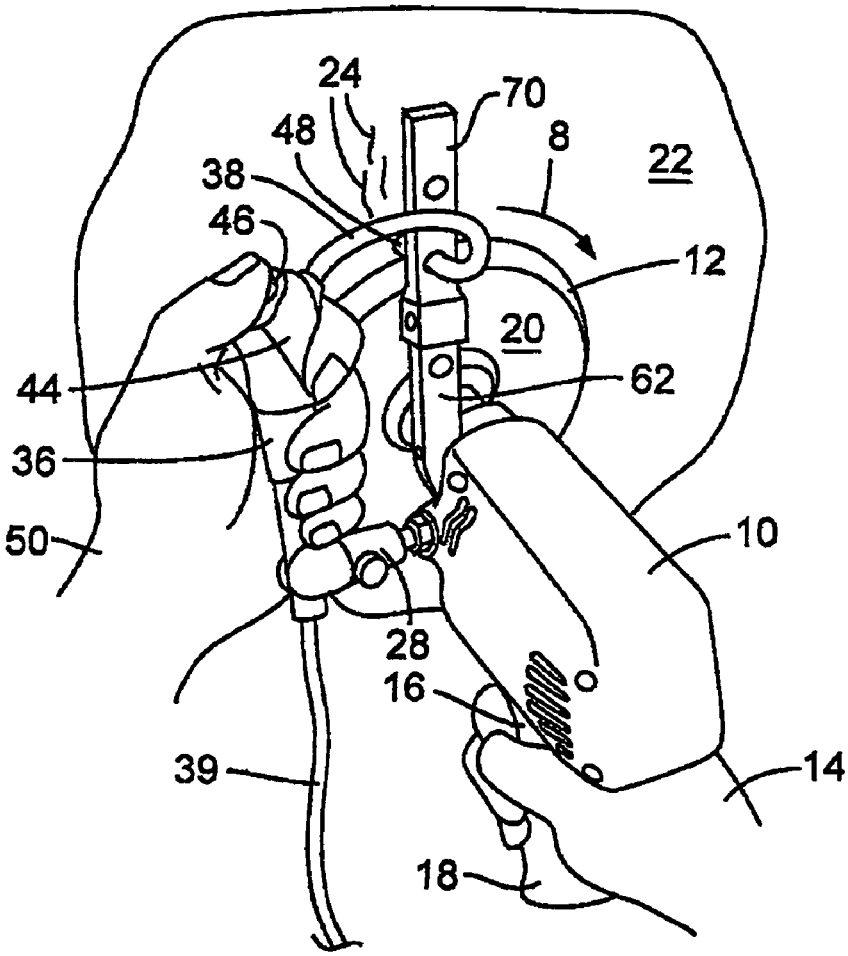

SCRATCH REMOVAL TOOL AND SYSTEM

RELATED APPLICATIONS

This application claims the benefit of U.S. Provisional Application No. 60/536,779, filed Jan. 16, 2004.

FIELD OF INVENTION

This invention relates to the removal of surface scratches on glass e.g., household picture windows, automobile windshields and the like, and more particularly relates to a tool including a liquid treatment applicator for removal of such scratches.

BACKGROUND OF THE INVENTION

Windows and windshields become scratched for a number of reasons e.g., a windshield wiper loses its rubber strip and the metal holder scrapes across the windshield. Such scratches are not structurally damaging to the windows or windshield but are visually undesirable and repair is desirable.

A process has been developed for removal of such scratches. A compound is applied to a circular disc or pad that is mounted on a hand-held power tool and the compound-containing face of the pad is rotated while in contact with the glass and moved along and/or across the scratch. The scratch is effectively erased by this process.

However, there is a need to controllably apply a liquid moisturizer, e.g. water, to the glass surface to maintain the desired consistency of the compound. Heretofore, moisturization was accomplished e.g. by the operator of the tool who held a spray bottle and sprayed the liquid onto the glass surface as he perceived the need to do so. Manipulation of the rotating pad substantially requires both hands for gripping the tool and application of the spray bottle required development of both a technique for one hand accomplishing both spray application and assisted control of the tool as well as learning the spray-on technique for achieving the desired consistency of the compound.

BRIEF DESCRIPTION OF THE INVENTION

The difficulties associated with the procedure described above are overcome with the addition of a pressurized applicator. Whereas the applicator can take many different forms, in a preferred embodiment, the applicator consists of a pressurized liquid source and a flexible conduit/hose from the liquid source to a liquid-emitting nozzle. A bracket strategically affixed to the tool includes a mount for the nozzle that, as mounted, directs the flow of liquid outboard of the pad periphery and onto a glass surface to be repaired. The flow of liquid through the nozzle is calibrated to substantially maintain the desired compound consistency during typical operation, and an on/off button is strategically located for operator on/off control of the liquid flow.

The bracket (in a preferred embodiment) is further designed to enable the operator to grip the bracket with his offhand for assisting in the stabilization of the tool. Additionally, the bracket mount for the nozzle provides alternate mount positions as may be desired for different sizes of pads, and preferably the nozzle as mounted directs a liquid spray normal to the glass surface for even application of the liquid.

Numerous variations to the structure as generally described is contemplated. The liquid source may be a pressurized container or a connection to a city water supply.

The mount may provide snap-out release of the nozzle for free-hand application as desired and/or adjustability of the liquid flow rate. Additionally, it may include friction fitting of the nozzle through the bracket for rapid adjustment of the spray direction, and alternate positioning of the bracket, e.g. for right and left hand users and the like. The invention and its many variations will be more clearly understood and appreciated upon reference to the following detailed description having reference to the accompanying drawings.

BRIEF DESCRIPTION OF THE DRAWING

FIG. 1 is a perspective view of a scratch-removing tool including the liquid applicator feature as incorporated into a preferred embodiment of the invention;

FIG. 2 is a perspective view of the tool of FIG. 1 but showing an operator operating the tool, including the liquid applicator;

DETAILED DESCRIPTION

Figure 3:
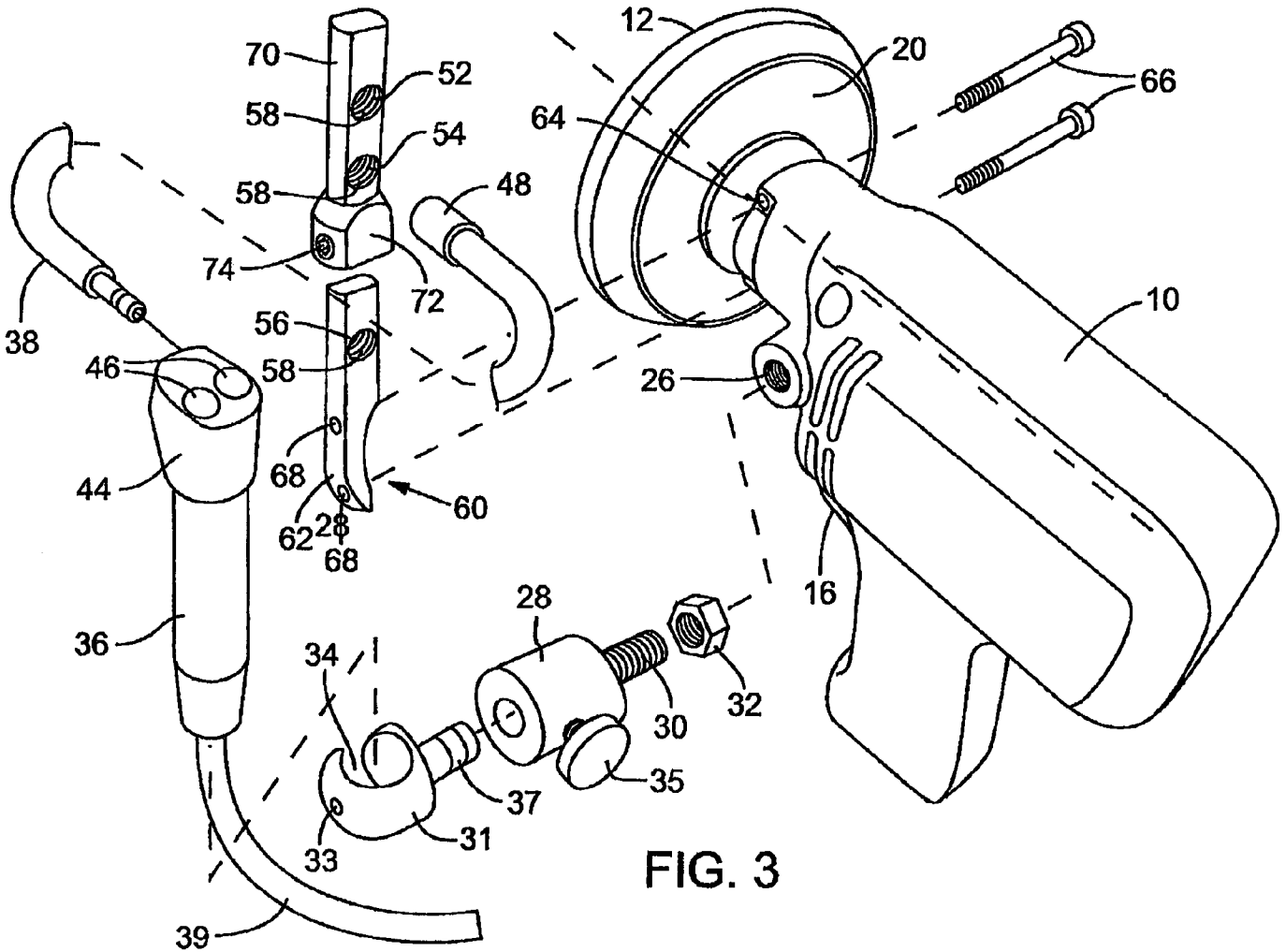
FIG. 3 is an exploded, perspective view illustrating the various components of the liquid applicator in detail.

Reference is first made to FIG. 2 of the drawings. Illustrated is an operator operating a powered hand tool, including a power head 10 and a circular pad or disk 12. As illustrated, the operator's right hand 14 operates a trigger switch 16 while gripping the handle 18. The disk 12 is accordingly rotated as indicated by arrow 8.

The circular disk 12 is of a type wherein a slurry material/compound can be applied to the face of the tool (opposite backing 20) and then the face of the disk 12 is placed in engagement with a window 22 having scratches 24. As the disk is moved over the scratches 24, the disk is maintained flat against the glass 22 and the pad with compound produces a scrubbing or polishing effect and removes the scratches. During this procedure, it is necessary to intermittently apply a spray, e.g. of water, onto the surface being treated. Such spray provides the compound with a desired consistency and also cools the glass surface. Depending on the type of glass, e.g., vehicle windshield versus household window, such cooling may be more or less desired, but in any event the application of the moistening spray for compound consistency is considered important.

Whereas the process as described in the preceding paragraph is not new, the problem for the operator not addressed therein is the awkwardness of handling both the spraying task and the scrubbing task, which multi-tasking is a primary objective of the present invention.

FIGS. 1–3 illustrate one embodiment of the invention and which includes a threaded mounting hole 26 (common to certain of such tool types—see FIG. 3). With particular reference to FIG. 3, a bracket 28 having a threaded shaft 30 is provided with a locking nut 32 that is screwed onto the shaft with a portion of shaft 30 projected through the nut. The projected portion of shaft 30 is screwed into hole 26 and the bracket is oriented as desired by the operator. The locking nut 32 is then screwed down against the housing of the power head 10 to secure that orientation of the bracket.

The bracket 28 includes a rotatively adjustable head portion 31 which enables adjustment as may be desired following assembly. The head portion 31 has a tapered receiving slot 34 strategically designed to receive a tapered hand piece 36. The hand piece 36 is shoved into the receiving slot 34 which frictionally grips the hand piece sufficiently to hold the hand piece in a desired orientation relative to the tool 10. As may be desired, the hand piece 36 may be more rigidly secured in the slot 34 by turning lock screw 33 into the side wall of the hand piece. The head portion 31 can be fixed against rotation relative to bracket 28 by turning lock screw 35 into engagement with shaft 37 of head portion 31.

Connected to the hand piece 36 is a hose or tube 39 which is connected also to any of a variety of liquid supply sources. For example, the liquid supply source may be a city water spigot or as shown in FIG. 1, it can be a canister 40 that contains a desired liquid, e.g. water and which is pressurized by a hand pump 42.

Receiving the pressurized liquid from hose 39 and which is a part of the hand piece 36 is a control fixture 44 including control switch or switches 46 (see FIG. 3) for on/off and/or flow rate control for controllably providing flow of liquid to hose 38. Connected to the opposing end of hose 38 is nozzle 48. Nozzle 48 is removably insertable into a selected one of receiving bores 52, 54, 56 of a nozzle positioning assembly 60. The nozzle positioning assembly 60 includes a lower bar 62 configured for mounting to the power head 10 having through bores 64. Mounting bolts 66 inserted through bores 64 are threadably affixed to lower bar 62 via threaded openings 68. The lower bar 62 includes receiving bore 58 and if a small diameter pad 12 is used, only the lower bar need be assembled to the power head. An upper bar 70 includes a socket portion 72 for assembly onto the lower bar and is secured thereto by lock screw 74.

Lining the receiving bores are O rings 58 that aid in the secure engagement of the nozzle 48 in the selected receiving bore and accordingly for directing liquid spray onto a work surface, e.g. glass window 22, as permitted by actuation of the control switch 46 (see FIG. 2). The alternative receiving bores 52, 54, 56 allow the desired placement of nozzle 48 at the periphery of the pad 12 for at least three different sizes of pads, e.g. 2", 4" and 6" diameter pads. As will be appreciated, the hand piece 36 is secured to the bracket so that the hand piece 36 is positioned for most convenient gripping by an operator.

Operation

The operator grips handle 18 (e.g. with his right hand as shown) whereby his index finger of that hand is able to manipulate the trigger switch 16 of the tool. (See FIG. 2.) The operator's other hand 50 grips the hand piece 36. As will be apparent, the strategic positioning of the control switch or switches 46 enables the operator to use his left hand to assist in control of the tool movement while also enabling the operator, using his left hand thumb, to operate the on/off and/or flow rate switch or switches 46.

Whereas the structure shown is considered the preferred embodiment, those skilled in the art will become aware of numerous alternative and additional features and variations that are encompassed within the general concept of the invention.

Figure 4:
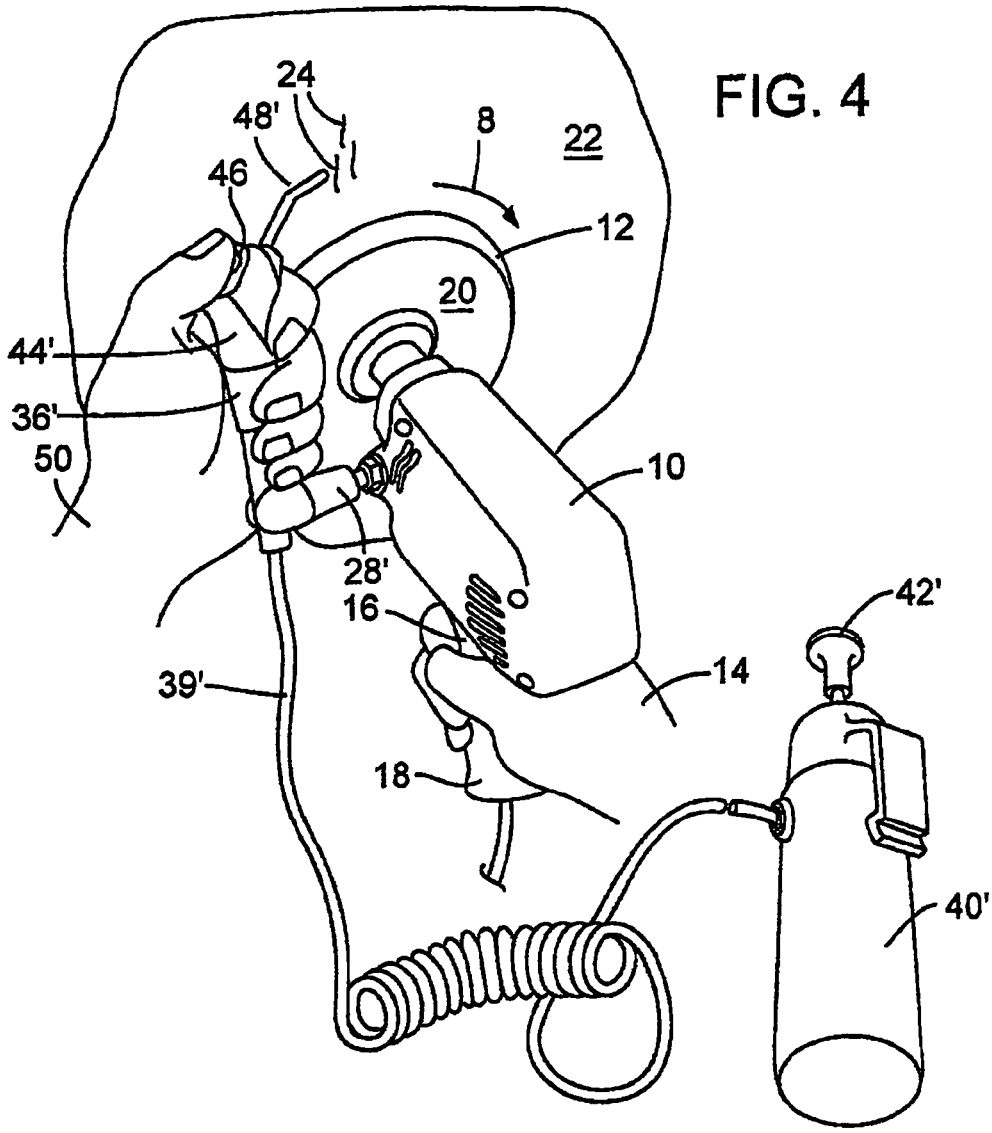
FIG. 4 is a view similar to FIG. 2 but showing an alternate embodiment.

An example of such an alternative embodiment is illustrated in FIG. 4. The components of the power head 10 and disk/pad 12 are as explained for the embodiments of FIGS. 1-3. The liquid applicator components (considered to be the bracket 28', hand piece 36', hose 39', water source, e.g. 40' and control fixture 44' having nozzle 48') are modified. Note that bracket 28' provides friction fit only and nozzle 48' is a rigid tube affixed to hand piece 36'. Such allows the operator to twist the hand piece 36' for manipulating the direction of the spray emitted from the nozzle 48'. Even further, the hand piece 36' can be lifted free of the bracket 28' for manipulation independent of tool 10. This can be beneficial in a cramped space, e.g. where both tool and applicator and both hands of the operator will not effectively fit the space wherein the repair is desired.

The invention as defined in the claims appended hereto is intended to encompass numerous other variations and alternatives that may be developed by those skilled in the art. Accordingly, the terms defining the invention are to be given their broad and ordinary meaning as used in the art.

The invention claimed is:

1. A scratch removal tool comprising:

a rotatable disk configured to receive a scratch-removing compound on a face, a hand-held powerhead for rotatably driving said disk and to position said disk's face against a scratch-bearing glass surface such that engagement of the rotating compound-carrying disk with the glass surface, removes the visual appearance of said scratch;

a moisturizing applicator including a spray-emitting hand piece, a nozzle connected to the hand piece, a conduit connected at one end to said hand piece and through said hand piece to said nozzle, and an opposing end of said hose conduit connected to a pressurized liquid source;

a bracket mounted to said powerhead for receiving the applicator and as mounted to said bracket, said nozzle of said applicator directing liquid spray onto the glass surface with said disk in scratch-removing operation;

said bracket cooperatively designed to provide a hand-hold for an offhand of an operator of the tool whereby both hands of the operator can participate in directing operation of the tool; and a nozzle positioning assembly configured to position the nozzle at different desired locations.

2. A scratch removing tool as defined in claim 1, wherein a control switch operatively controlling nozzle spray is mounted to the tool and relative to the bracket whereby the operator can actuate the on/off and/or flow rate operation of the switch with the offhand while continuing to grip the bracket.

3. A scratch removal tool as defined in claim 1 wherein the nozzle positioning assembly is a separate component than either the bracket or the nozzle.

4. A scratch removal tool as defined in claim 1 wherein the hand piece is mounted to the bracket and as mounted to the bracket cooperatively provides the off hand hand-hold for the operator.

5. A scratch removal tool as defined in claim 4 wherein the hand piece includes an on/off switch strategically located for operation by the operator while continuing hand control of the tool by the off hand.

6. A scratch removal tool as described in claim 1 wherein a plurality of mount positions are provided for mounting said nozzle, said mount positions spaced outwardly of the disk periphery for different diameter disks and as mounted and with the tool in operation, directing liquid spray at a substantially normal angle to the glass surface being treated.

7. A scratch removal tool as defined in claim 1 wherein the nozzle is mounted directly to the hand piece and the direction of liquid spray is controlled by the orientation of the hand piece.

8. A scratch removal tool as defined in claim 1 wherein the hand piece is removably mounted to the bracket for ready removal and adjustment by the operator.

* * * * *

UNITED STATES PATENT AND TRADEMARK OFFICE

CERTIFICATE OF CORRECTION

PATENT NO. : 7,144,312 B2
APPLICATION NO. : 10/992869
DATED : December 5, 2006
INVENTOR(S) : Michael P. Boyle It is certified that error appears in the above-identified patent and that said Letters Patent is hereby corrected as shown below:

Figure 3
Reference number "28" between reference numbers 62 and 68 should be deleted.

Figure 4
Reference number "42" should be deleted.

Column 2
Line 37, "...glass 22..." should read --...window 22...--.

Column 3
Line 2, "...the tool 10..." should read --...the power head 10...--.
Line 25, "...receiving bore 58..." should read --...receiving bore 56...--.

Column 4
Line 1, "...tool 10..." should read --...power head 10...--.

Signed and Sealed this

Twenty-sixth Day of May, 2009

John Doll

JOHN DOLL
*Acting Director of the United States Patent and Trademark Office*